US008299444B2

(12) United States Patent
Ding et al.

(10) Patent No.: US 8,299,444 B2
(45) Date of Patent: Oct. 30, 2012

(54) ION SOURCE

(75) Inventors: Li Ding, Shanghai (CN); Wenjian Sun, Shanghai (CN)

(73) Assignee: Shimadzu Research Laboratory (Shanghai) Co. Ltd., Shanghai (CN)

( * ) Notice: Subject to any disclaimer, the term of this patent is extended or adjusted under 35 U.S.C. 154(b) by 582 days.

(21) Appl. No.: 12/552,476

(22) Filed: Sep. 2, 2009

(65) Prior Publication Data

US 2011/0049352 A1 Mar. 3, 2011

(51) Int. Cl.
*H01J 49/16* (2006.01)

(52) U.S. Cl. ..... 250/423 P; 250/282; 250/288; 250/423 R; 250/424; 250/425

(58) Field of Classification Search ..... 250/281–300, 250/423 R, 424, 425, 423 P
See application file for complete search history.

(56) References Cited

U.S. PATENT DOCUMENTS

| | | | | |
|---|---|---|---|---|
| 4,564,355 | A * | 1/1986 | Traiger et al. | 433/215 |
| 2003/0052268 | A1* | 3/2003 | Doroshenko et al. | 250/288 |
| 2004/0129876 | A1* | 7/2004 | Franzen | 250/288 |
| 2004/0174425 | A1* | 9/2004 | Akamatsu | 347/236 |
| 2005/0197655 | A1* | 9/2005 | Telfair et al. | 606/5 |
| 2006/0097143 | A1* | 5/2006 | Franzen | 250/282 |
| 2007/0187589 | A1 | 8/2007 | Cooks et al. | |
| 2008/0296485 | A1* | 12/2008 | Benter et al. | 250/282 |
| 2009/0272892 | A1* | 11/2009 | Vertes et al. | 250/282 |
| 2010/0012831 | A1* | 1/2010 | Vertes et al. | 250/282 |

FOREIGN PATENT DOCUMENTS

CN 101216459 7/2008

OTHER PUBLICATIONS

Cody, Robert B. et al. "Versatile New Ion Source for the Analysis of Materials in Open Air under Ambient Conditions" *Anal. Chem.* 2005;77:2297-2302.

Coon, Joshua J., "Atomospheric pressure laser desportion/chemical ionization mass spectrometry: a new ionization method based on existing themes" *Rapid Comm. Mass. Spectrom.* 2002; 16:681-685.

Haapala, Markus et al. Desorption Atmospheric Pressure Photionization *Anal. Chem.* 2007;79:7867-7872.

Shiea, Jentaie et al. "Electrospray-assisted laser desorption/ionization mass spectrometry for direct ambient analysis of solids" *Rapid Comm. Mass. Spectrom.* 2005;19:3701-3704.

Takats et al."Mass Spectrometry sampling Under Ambient Conditions with Desorption Electrospray Ionization" *Science* 306;2004:471-473.

* cited by examiner

*Primary Examiner* — Michael Logie
(74) *Attorney, Agent, or Firm* — Dorsey & Whitney LLP

(57) ABSTRACT

This invention relates to a desorption/ionization source operated under ambient conditions for direct analysis of solid or liquid samples on a surface. The source comprises of a laser desorption system and a UV/electrospray combined ionization system. The source is suitable for simultaneously ionizing samples with different polarity in a complex mixture. At the same time, the compact design of the source with multiple channels can maintain the level of local concentration of the analyte ions inside the source for higher efficiency of sample ionization and introduction.

23 Claims, 3 Drawing Sheets

ION SOURCE

FIELD OF THE INVENTION

This invention relates to desorbing analytes from solid or liquid sample surface with laser and ionizing the desorbed or vaporized analytes with UV lamp under ambient conditions in order to perform mass analysis of the analytes. At the same time this invention also involves combining the method described above and another direct analysis method with the aim of further increasing the ionization efficiency of analytes in different chemical classes.

BACKGROUND OF THE INVENTION

With the widespread use of mass spectrometry in the fields of food safety, pharmaceutical research and biochemical applications, it has become increasingly important to be able to mass analyze samples directly under atmospheric conditions for rapid identification of unknown samples.

The emergence of electrospray ionization (ESI) and atmospheric pressure matrix-assisted laser desorption/ionization (AP-MALDI) have partially solved the issue for ionizing analytes in the liquid and solid form, respectively, under atmospheric pressure. However, to analyze samples from solid surface by AP-MALDI a certain matrix has to be premixed with the analytes on the surface, which makes it difficult for rapid screening of large quantity of solid samples. In order to overcome this limitation many direct analysis methods for solid samples based upon various principles have been proposed and verified. *Science,* 2004, 306, 471-273. introduced the first direct analysis method which involves using electrosprayed droplets to desorb/ionize solid samples directly from surface and send the ions formed into a mass spectrometer. The speed and simplicity of this method greatly enhanced the applicability of mass spectrometry to direct analysis in field.

Soon after the DESI technique was announced, several other direct analysis methods also achieved success. For example, *Anal. Chem.* 2005, 77, 2297-2302. introduced a method called direct analysis in real time (DART) which replaced the electrosprayed droplets with metastable He atoms as the means to desorb analytes from solid surface. In some other related examples as described in the U.S. Pat. Appl. 20070187589 and *Anal. Chem.* 2007, 79, 7867-7872, methods such as desorption atmospheric pressure chemical ionization (DAPCI) and desorption atmospheric pressure photoionization (DAPPI) have been described, respectively. The latter two methods complement the DESI method to some extend due to their capability for ionization relatively less polar species.

However, the methods mentioned above all use either molecular or ion beam to desorb analytes from surface, and therefore it is very difficult to control the area of desorption and to perform chemical imaging of the sample surface. To overcome this limitation *Rapid Commun. Mass Spectrom.* 2005, 19, 3701-3704. introduced an electrospray assisted laser desorption (ELDI) method which greatly enhanced the spatial resolution of the sampling process by using laser as the desorption means. In this method the sampling area limited by the size of the laser spot can be accurately defined. At the same time, the electrospray process involved in this technique is advantageous for analyzing polar species. A similar technique described in *Rapid Commun. Mass Spectrom.* 2002, 16, 681-685. also used laser as desorption means but used chemical ionization to ionize the desorbed analytes in the gas phase, which is complementary to the ELDI technique since it is suitable for analyzing less polar and relatively small molecules. Nevertheless, the non-polar analytes in the atmosphere still remained to be ionized more efficiently by photoionization, since high energy photons can directly ionize the analytes in the gas phase without charge transfer process. While the DAPPI technique uses UV photons for ionization, again the heated gas stream as desorption means lacks high spatial resolution for chemical imaging application.

Although a Chinese Pat. publication CN101216459A has described a technique involving laser desorbing and post UV ionizing analytes from surface, the entire process in this method occurred in the vacuum. This largely limits the use of the ion source for the goal of direct analysis due to the slow and inconvenient process of vacuum loading.

One of the goals of this invention is to combine the merits of the laser desorption and the photoionization techniques so that the laser based ionization methods can cover a broader range of chemical classes. At the same time, this invention will circumvent the limitation of the slow vacuum loading process by performing all the ionization process under ambient conditions. Another goal of this invention is to combine the laser desorption photoionization method described in this invention with ELDI with the aim of analyzing chemicals in different classes simultaneously, by which frequent switching among different types of ion sources can be avoided.

SUMMARY OF THE INVENTION

A goal of this invention is to provide a desorption/ionization source for direct analysis of samples on surface under ambient conditions for mass spectrometers. The source includes a laser and related laser focusing optics for sample desorption with high spatial resolution, a UV lamp nearby for ionizing the desorbed analytes, especially non-polar analytes, and an inlet to a mass spectrometer for transferring the analyte ions.

Another goal of this invention is to provide a combined ionization source for direct analysis of samples on surface under ambient conditions for mass spectrometers. The source includes a laser and some related laser focusing optics for sample desorption, a UV lamp nearby for ionizing the desorbed species, an electrospray source for generating solvent droplets and transferring solvent vapor in the region above the desorption area in order to improve the ionization efficiency of some analytes, and an inlet to a mass spectrometer for transferring the analyte ions.

In one of the operating modes of this invention, the solvent vapor transferred by the electrospray source was excited or ionized by the UV radiation from the UV lamp, and the excited or ionized solvent species will then ionize the desorbed or vaporized analytes by charge transfer or Penning processes. With the addition of the solvent species from the small hollow tube the efficiency of the photoionization process can be enhanced significantly, especially for those analytes with ionization energy higher than the energy of the UV photons.

Whereas in another operating mode of this invention, the charged droplets generated at the tip of the electrospray source can be combined with the desorbed or vaporized analyte molecules in order to enhance the ionization efficiency for polar analyte molecules.

Another goal of this invention is to provide a method of desorbing/vaporizing samples gradually from surface by controlling the laser output power in order to provide one more dimension of separation for complex sample mixtures.

Furthermore, another goal of this invention is to provide a specific design for desorption/ionization of sample from surface under ambient conditions for mass spectrometers. The source includes a chamber composed of an optical system, a UV lamp, an electrospray source, a corona discharge needle and an inlet to a mass spectrometer. The optical system is for focusing the laser onto the surface of the sample in order to desorb or vaporize the analytes. The UV radiation from the UV lamp will cause ionization of at least a portion of the desorbed or vaporized analytes. The electrospray source will enhance the ionization efficiency of at least a portion of the analytes by supplying either solvent droplets or solvent vapor in the region above the desorption area. The ionized analytes will then be transferred to a mass spectrometer through the inlet.

The laser used for desorption/vaporization in this invention can be small and low cost diode IR laser.

The desorption/ionization source described in this invention can further include a mobile sample holder for scanning the sample surface with the laser.

DETAILED DESCRIPTION OF EMBODIMENTS

The current invention is ideal for desorbing/ionizing analytes either in the solid or liquid form on the surface under ambient conditions. This process can be achieved by using laser as the desorption means and using either UV lamp or UV combined with electrospray as the ionization means, and the latter can more efficiently ionize different components in a mixture of different analytes.

Figure 1:
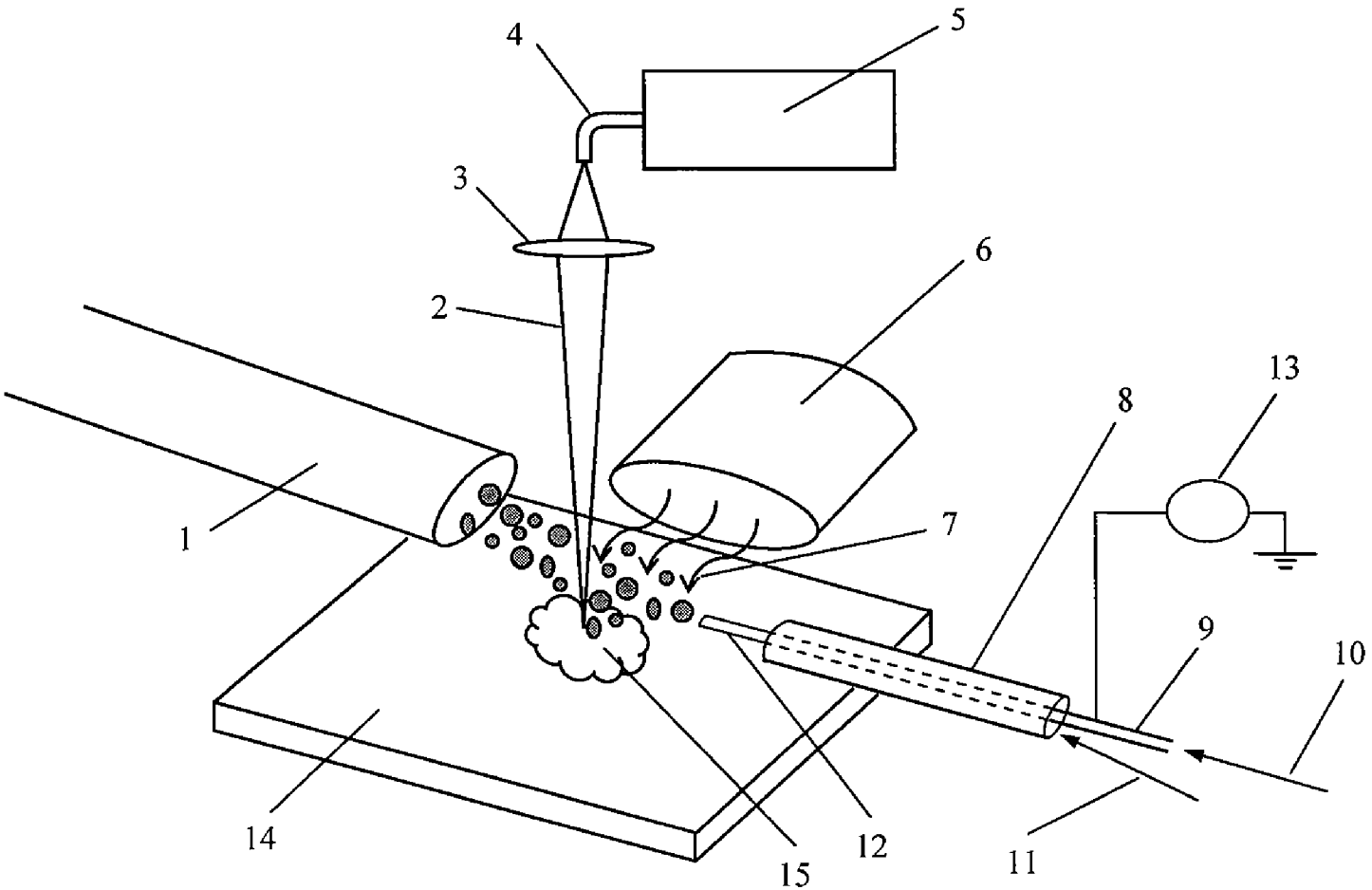
FIG. 1 is a schematic view of a system for laser desorption photoionization according to one of embodiments of the current invention.

As shown in FIG. 1, the laser used for desorption is a diode IR laser 5 and its wavelength ranging from 800 to 1200 nm. The laser is normally operated at the continuous mode, but it can be operated at the pulse mode by using fast power switches. The laser beam 2 is transferred into the ion source through fiber optics after leaving the laser. The laser beam is focused onto the sample surface after passing through an optical lens 3. UV laser, such as Nitrogen laser (337 nm) and Nd/YAG laser (355 nm) can also be used as the desorption means. However, the laser intensity has to be well controlled at low level in order to avoid fragmenting the target analytes.

The UV lamp used for ionization is a vacuum UV (VUV) lamp 6 with shorter than 200 nm wavelength. The energy of the emitted photons from the VUV lamp ranges from 10 to 12 eV. Photons at this energy range will be strongly absorbed by oxygen in the atmosphere; therefore the photons can only travel a very short distance in the atmosphere before they are depleted. Consequently the front of the VUV lamp has to be mounted inside the ion source chamber (but not blocking the laser for desorption) to facilitate ionization of the desorbed species in the chamber.

The electrospray system used for assisting ionization process includes an electrospray needle 12, nebulizing capillary 8, and a high voltage power supply 13. The solvent 10 used for electrospray can be the same as normal electrospray solvent such as a mixture of methanol and water. The nebulizing gas used can be nitrogen or other common gas. The voltage is ideal to be controlled between 3 and 5 kV for normal operation of electrospray.

Figure 2:
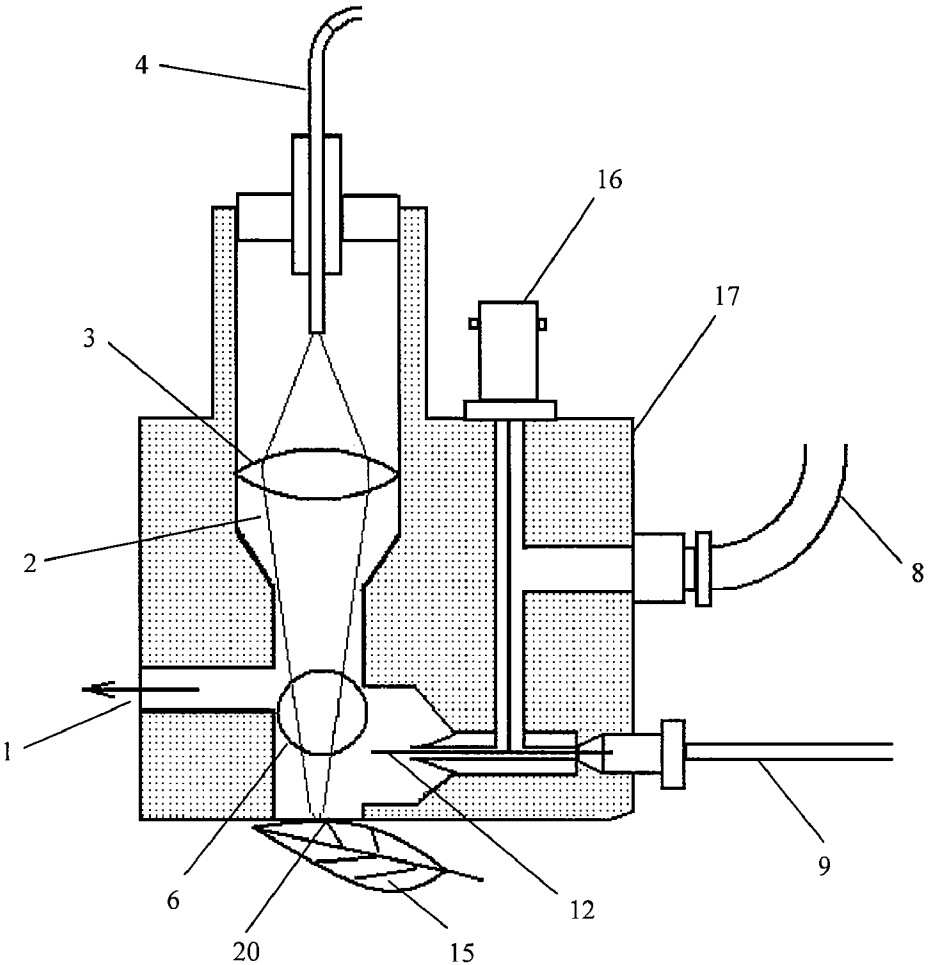
FIG. 2. is a system with chamber type design described in one of the embodiments of the current invention.

FIG. 2 illustrates the design of the ion source chamber with multiple channels. The ion source chamber 17 can be made of aluminum or plastic material and the inner surface can be coated with stable and conductive material such as gold for even distribution of the electric field. To ease the fabrication and cleaning processes of the chamber, the chamber can be composed of two parts, and each part can contain one half of the chamber. The two parts are aligned with locating studs and locked by locating nuts.

Figure 3:
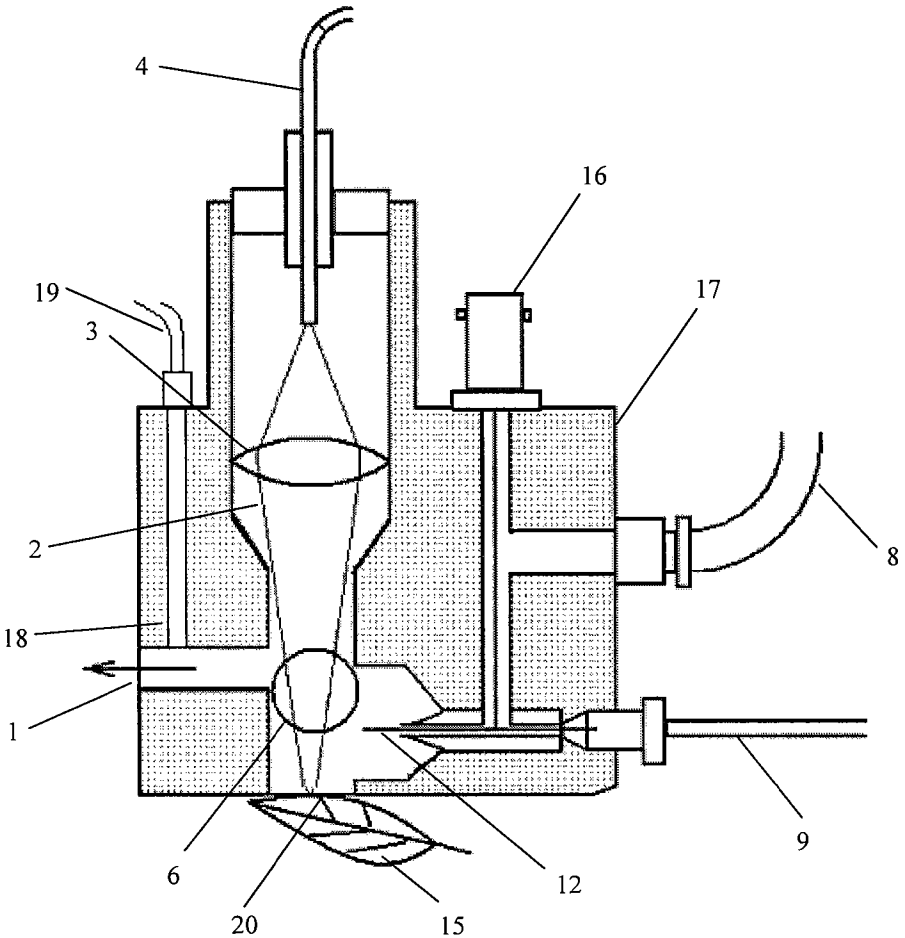
FIG. 3. is a system with chamber type design described in one of the embodiments of the current invention where a purging system is implemented.

One important issue when using chamber type design is the memory effect. Since the space in the chamber is small and enclosed and therefore the excessive species will still stay in the region for a period of time after the analysis. Hence a purging system is implemented in the chamber as shown in FIG. 3. The opening port 18 for the purging gas line is located near the inlet to the mass spectrometer. The port is connected to a gas line 19 through a small channel. The gas supplied for purging can be nitrogen or any other types of inert gases. The purging gas was pumped into the chamber by the pressure from a gas cylinder and the gas flow rate in the gas line is controlled by a gas valve located outside of the chamber. The purging gas can exit the chamber from the sampling orifice 20.

Samples can be placed on the mobile sample holder 14 during the process of analysis. Alternatively, the sample can also be held by forceps and positioned near the sampling orifice at the bottom of the ion source chamber. No matter which way of sample holding is adopted, the sample surface need to be as close as possible to the sampling orifice so as to facilitate the entrance of ions into the ion source chamber 17.

For the first operating mode of the ion source, namely the mode of laser desorption/photoionization, the process is described as follows. When the laser desorbed species entered the ion source chamber 17, some of them will be ionized by the UV photons emitted by the VUV lamp. However, the VUV photon energy is not always high enough for directly ionize any analytes, and the transmission of the VUV photons is very limited in the atmosphere. Hence, dopant gas such as toluene is frequently needed for indirectly ionizing the analytes through charge transfer processes (refer to Anal. Chem. 2000, 72, 3653-3659. Therefore, another goal of the electrospray source is to introduce the dopant gas or vapor (also referred as solvent gas in this invention). The procedure can be realized by introducing liquid dopant such as toluene through solvent channel 9, or introducing gas dopants such as methane through nebulizing capillary. As a result, the ion source working under this mode can directly or indirectly (through charge transfer) ionize desorbed analytes, and therefore it is very suitable for ionizing less polar or even non-polar molecules.

Note that compared with the DAPPI and many other direct analysis methods operated in the open space under ambient conditions, this embodiment adopts a compact chamber design and therefore the local concentration of the analytes can be higher.

Nevertheless, the real samples are normally complex mixtures of multiple components. The molecular weight and polarity of each component can be significantly different. In order to enhance the ionization efficiency of larger and highly polar analyte molecules such as proteins and peptides in the mixture, the electrospray generated droplets can fuse with these polar molecules in the gas phase (desorbed by the laser) and transfer charges to them thereafter. Thus the capability of the source for ionizing mixture can be very high when both VUV lamp and ESI are turned on at the same time.

Therefore, the second operating mode of the ion source is to use laser to desorb or vaporize samples from surface first and then to use VUV and electrospray to ionize the analytes simultaneously. In this mode the electrospray source has dual functions—providing electrosprayed droplets for fusing with the gaseous analytes and for providing dopant gas for assisting photoionization.

Since the source can ionize a broad range of chemicals in the second operating mode, it becomes viable to analyze a complex sample mixture with the source. In order to more efficiently separating analytes in a complex mixture, the laser power can be gradually increased so that species with low threshold desorption/vaporization temperature will come out first whereas those with high threshold temperature will come out later. Therefore, a separation process is implemented before mass analysis, which is important for decreasing signal suppression and peak congestion. The power output of the laser can be controlled in two ways. For those continuous wave laser such as diode laser, the laser beam can be chopped electrically by modulating the power supply of the laser. By controlling both the duty cycle and the repetition rate of the modulation process, the power output of the laser can be varied. For those pulsed laser such as nitrogen laser, the power output can be varied by changing the attenuation ratio of the neutral density filter used for laser power adjustment. In this case, the rotation speed of the wheel of a neutral density filter can be controlled by a computer through a motor.

As mentioned above, the spatial resolution of the source for desorption is much higher when using laser rather than electrosprayed droplets as the desorption means as in the desorption electrospray ionization (DESI) method. This feature makes it suitable for chemical imaging under atmospheric pressure. To perform an imaging experiment, a mobile sample holder 14 with three degrees of freedom (X, Y, and Z) is mounted at the bottom of the source near the entrance, and the movement of the holder on each axis can be controlled by a computer through a step motor. The mass spectrometer can record the chemical information (mass to charge ratio) of each point scanned when the sample holder is moved relative to the laser spot. After consolidating the chemical information for all the points, an image of the surface with information of mass distribution can be recovered.

Also note that although this invention and the one described in the Chinese Pat. Publication CN101216459A both involve laser desorption and UV ionization of samples on surface, the main difference between the two is that the source in the current invention operates under ambient conditions whereas the other one operates in the vacuum. The capability of operating the source in the atmosphere can greatly enhance the sampling speed since no vacuum loading process is needed. Furthermore, liquid samples are easier to be analyzed under the ambient conditions since they would evaporate rapidly once loaded into a vacuum chamber.

While the present invention has been described above in terms of specific embodiments, it is anticipated that alterations and deviations to this invention will no doubt become apparent to those skilled in the art. For example, the pressure in the ion source may deviate from one atmosphere due to the pumping of the gas at the inlet of the mass spectrometer. Additionally, while the current invention only incorporates photoionization and electrospray as the post ionization methods, it can be readily expected that other post ionization methods such as chemical ionization can be integrated into this source in order to further increase the versatility of the source for various samples.

What is claimed is:

1. An atmospheric pressure desorption/ionization source comprising:

a laser and related optical system for desorbing or vaporizing analytes from a solid or liquid sample surface;

a UV lamp near a desorption/vaporization region for photoionizing at least a portion of the desorbed/vaporized analytes;

a spray source for introducing a dopant to an area above the desorption/vaporization region in order to assist the photoionization process by directly or indirectly ionizing the desorbed/vaporized analytes; and an ion inlet connecting the atmospheric pressure desorption/ionization source to a mass spectrometer.

2. The atmospheric pressure desorption/ionization source according to claim 1, wherein said spray source is an electrospray source.

3. The atmospheric pressure desorption/ionization source according to claim 2, wherein said spray source further comprises a chamber, said chamber comprises multiple channels among which a main channel has a top end for mounting the optical system, a side for mounting the UV lamp, and a bottom end for positioning the ion inlet, and said chamber further comprises two branched channels in which the ion inlet to the mass spectrometer and the electrospray source are mounted.

4. The atmospheric pressure desorption/ionization source according to claim 2, further comprising a chamber, where the UV lamp, a part of the optical system and said electrospray source can be mounted inside the chamber, and one outlet of the chamber is the inlet connecting the mass spectrometer.

5. The atmospheric pressure desorption/ionization source according to claim 2, wherein the spray source includes an electrospray needle, and wherein the atmospheric pressure desorption/ionization source is configured to spray the dopant from the electrospray needle at a high voltage.

6. The atmospheric pressure desorption/ionization source according to claim 1, further comprising a chamber where the UV lamp, a part of the optical system, and said spray source can be mounted inside the chamber, and one outlet of the chamber is the inlet connecting the mass spectrometer.

7. The atmospheric pressure desorption/ionization source according to claim 1 or 2, wherein said spray source further comprises a mobile sample holder on which the analytes are placed; and the laser can scan across the sample surface by moving the mobile sample holder.

8. The atmospheric pressure desorption/ionization source according to claim 1, wherein said UV lamp is a vacuum UV lamp with a wavelength shorter than 200 nm.

9. The atmospheric pressure desorption/ionization source according to claim 1, wherein said spray source further comprises a chamber, said chamber comprises a purging system which includes a port for introducing nitrogen or an inert gas into the chamber, a gas line for transferring the gas, and a valve for controlling the amount of gas introduced.

10. The atmospheric pressure desorption/ionization source according to claim 9, wherein said laser is a continuous wave laser and the laser output power can be varied by modulating the power supply of the laser.

11. The atmospheric pressure desorption/ionization source according to claim 9, wherein said laser is a pulsed laser and the laser output power can be varied by changing the attenuation ratio of a neutral density filter through which the laser passes.

12. The atmospheric pressure desorption/ionization source according to claim 1, wherein an output power of said laser can be gradually increased during the course of sampling in order to desorb/vaporize samples with a different threshold desorption/vaporization temperature at a different time.

13. The atmospheric pressure desorption/ionization source according to claim 1, wherein said laser is a diode IR laser.

14. The atmospheric pressure desorption/ionization source according to claim 1, wherein said laser optical system comprises compatible fiber optics and focusing lens.

15. The atmospheric pressure desorption/ionization source according to claim 1, wherein the spray source includes a channel, wherein the dopant is introduced through the channel.

16. The atmospheric pressure desorption/ionization source according to claim 15, wherein the channel is a solvent channel or a nebulizing capillary.

17. A method for direct analysis of samples from a surface in atmospheric pressure, comprising:

desorbing/vaporizing analytes from a sample surface using a laser;

forming ions by photoionizing the desorbed/vaporized analytes using a UV lamp; and introducing a dopant with a spray source to a region above a desorption/vaporization area in order to assist the photoionization process by directly or indirectly ionizing the desorbed/vaporized analytes.

18. The method of claim 17, wherein forming ions from desorbed/vaporized analytes further includes using electrosprayed droplets to generate charges on the analytes.

19. The method of claim 17 or 18, wherein forming ions from desorbed/vaporized analytes further includes implementing a chamber with multiple channels for ionization processes.

20. The method of claim 19, further includes purging the chamber by introducing nitrogen or an inert gas into the chamber through a port on the chamber at a rate controlled by a gas valve.

21. The method of claim 17 or 18, further includes conducting sample imaging with scanning the laser across the sample surface by moving a mobile sample stage.

22. The method of claim 17 or 18, further includes controlling the power output of the laser by modulating the power supply of the laser when using a continuous wave laser.

23. The method of claim 17 or 18, further includes controlling the power output of the laser by varying the attenuation ratio of a neutral density filter when using a pulsed laser.

* * * * *